US005451974A

United States Patent [19]

Marino

[11] Patent Number: 5,451,974

[45] Date of Patent: Sep. 19, 1995

[54] RETRACTABLE HELICAL ANTENNA

[76] Inventor: Frank Marino, 9 Hazeltine Rd., Upton, Mass. 01568

[21] Appl. No.: 293,092

[22] Filed: Aug. 19, 1994

Related U.S. Application Data

[63] Continuation of Ser. No. 79,263, Jun. 21, 1993, abandoned.

[51] Int. Cl.[6] ..... H01Q 7/36

[52] U.S. Cl. ..... 343/895; 343/714; 343/889

[58] Field of Search ..... 343/895, 889, 750, 715, 343/714, 903, 906, 745, 723, 823

[56] References Cited

U.S. PATENT DOCUMENTS

| | | | |
|---|---|---|---|
| 2,953,934 | 9/1960 | Sundt | 343/903 |
| 2,993,204 | 7/1961 | Macalpine | 343/752 |
| 3,085,215 | 4/1963 | Shepherd | 343/750 |
| 4,063,206 | 12/1977 | Walker | 343/750 |
| 5,274,393 | 12/1993 | Scott | 343/702 X |

*Primary Examiner*—Donald Hajec
*Assistant Examiner*—Tho G. Phan
*Attorney, Agent, or Firm*—Francis E. Marino

[57] ABSTRACT

A retractable antenna assembly having a helically coiled antenna, a bushing having a helically threaded hole fully therethrough which freely engages the helical coil, and a driver to cause helical motion to the antenna relative to the bushing, and thereby extend or retract the antenna.

2 Claims, 5 Drawing Sheets

RETRACTABLE HELICAL ANTENNA

CROSS REFERENCE TO RELATED APPLICATION

This is a continuation of application(s) Ser. No. 08/079,263 filed Jun. 21, 1993, now abandoned.

FIELD OF THE INVENTION

The present invention deals with retractable antennas, particularly those antennas which employ a shape that is helical, such as the antennas commonly used with cellular telephones in automobiles, and with a mechanism to facilitate the retraction and extension of such antennas.

BACKGROUND OF THE INVENTION

Retractable antennas are well known and commonly used, particularly for radios in automobiles where it is advantageous to have the antenna unexposed to damage, vandalism, theft, and the like when the radio is not in use. Retraction of the antenna for a transmitting-/receiving device such as the automobile radio reduces the opportunity for vandalism when the automobile is unattended, and for damage such as that possible as the automobile passes through an automatic car-wash. The growth in sales of such retractable antennas despite their additional initial cost to the consumer prove the value of such a feature to the marketplace.

The shafts of those antennas made to date are basically long thin cylindrical shafts which are either solid rods, hollow tubes, or a series of incrementally sized hollow tubes configured to form a telescoping tube assembly. Those antennas are retracted and extended through displacement along the axis of the cylindrical shaft by any one of a variety of motor driven or hydraulic methods which generally move the shaft through a flanged guide bushing that is fixed to a mounting surface such as the automobile fender.

The recent increases in the use and sales of cellular telephones for automobiles present a similar need to the consumer for a retractable cellular telephone antennas, yet those antenna used for the transmission/reception of cellular radiowaves employ a shaft whose shape is helical and therefore not well adapted for the axial displacement used for the common cylindrical antennas.

SUMMARY OF THE INVENTION

In view of the above, the invention hereby disclosed comprises a mechanism to facilitate the retraction and extension of a helically shaped antenna shaft by using the shaft helix itself and a mating helix within the guide bushing as a screwthread type interface which guides and/or limits the displacement of the shaft such that the shaft will be displaced helically as it is rotated about the axis of the helix, or as it is driven axially by a device which allows such rotation.

DESCRIPTION OF THE PRESENT INVENTION

Figure 1:
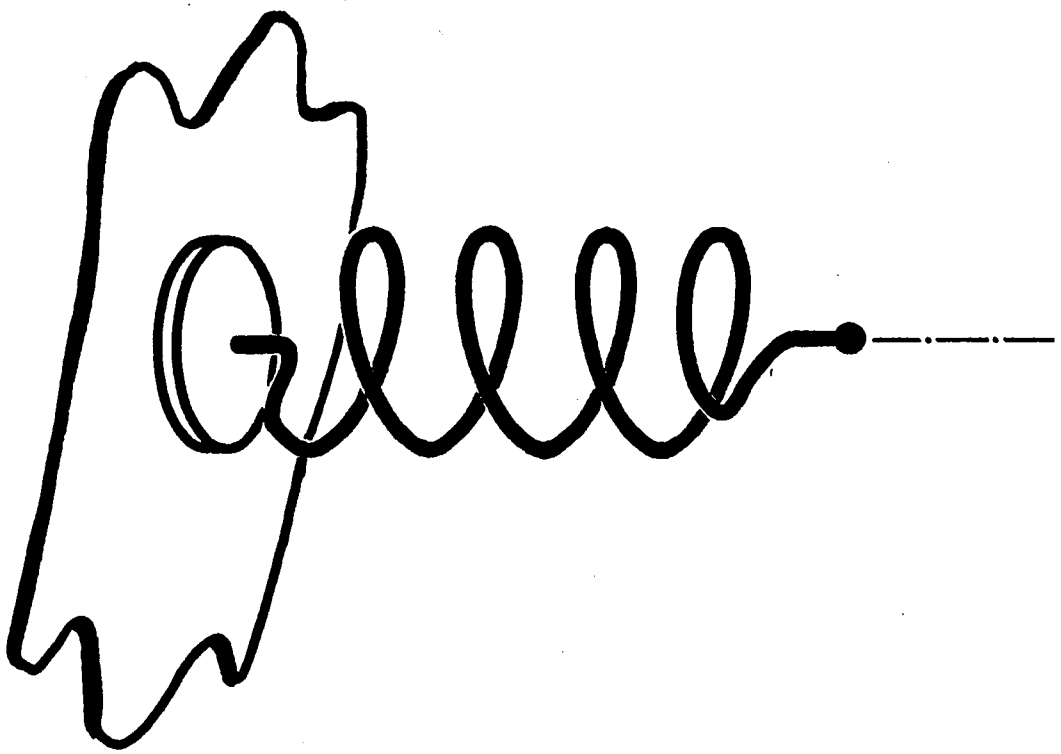
FIGURE 1 (PRIOR ART)
FIG. 1 is a perspective view of a common cellular telephone antenna employing a helically coiled shaft.

While the present invention could be embodied in various forms, shown in the drawings are preferred embodiments, with the understanding that the present disclosures are to be considered as examples of the invention, and are not intended to limit the invention to the specific embodiments illustrated.

Figure 2:
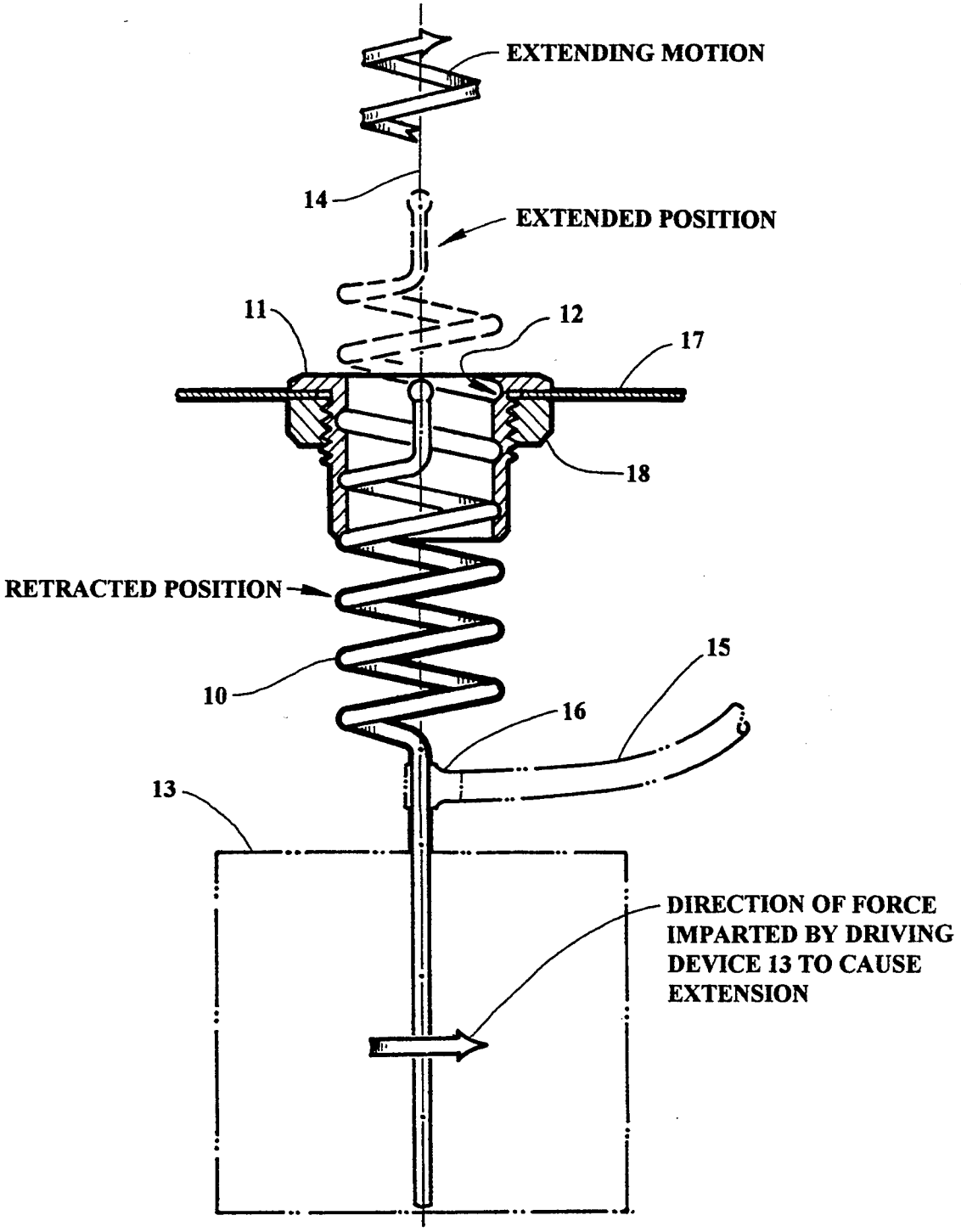
FIG. 2 is a cross sectional view of an embodiment of the invention employing a rotational driver with said driver represented schematically.
Figure 3:
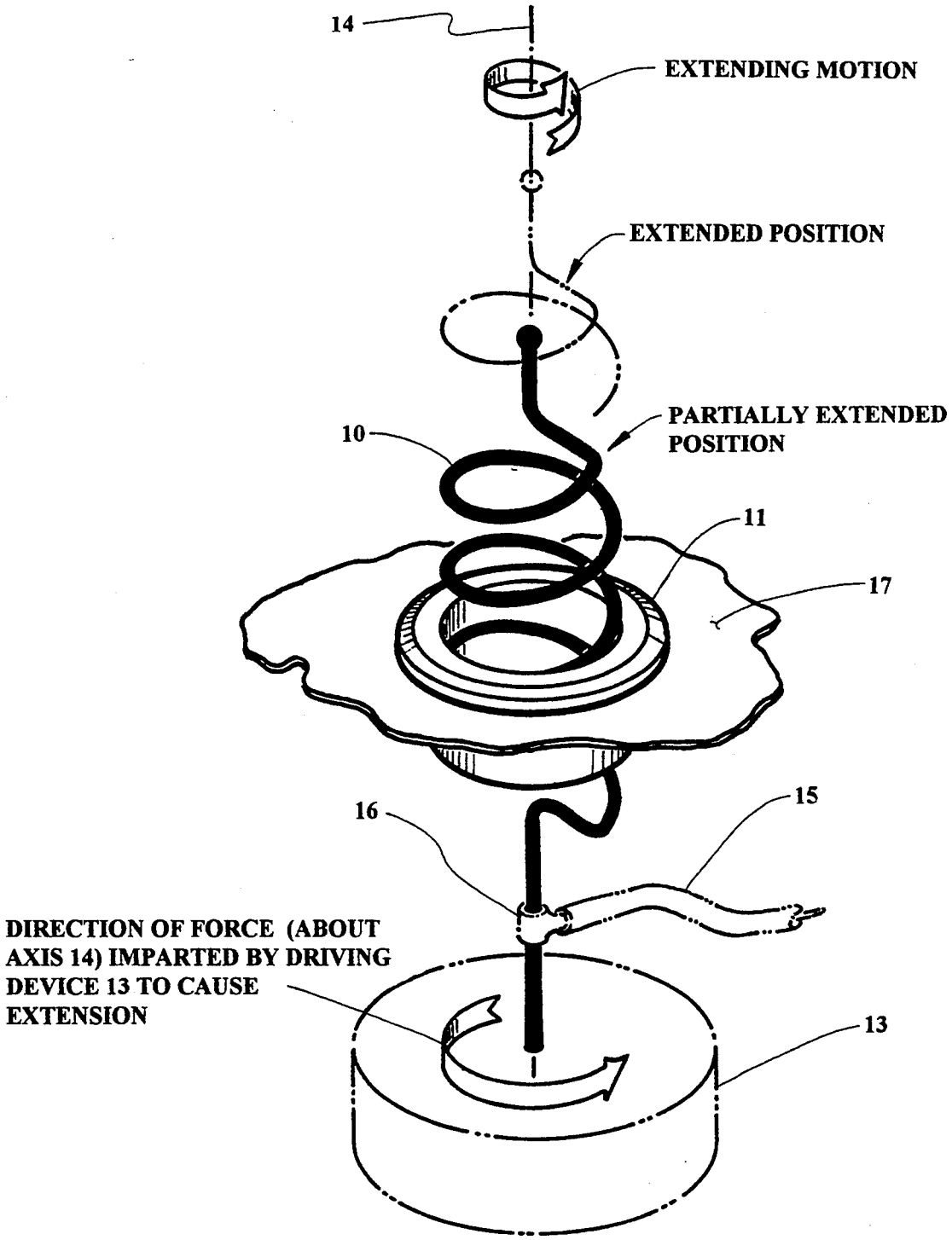
FIG. 3 is a perspective view of the embodiment of the invention of FIG. 2.
Figure 4:
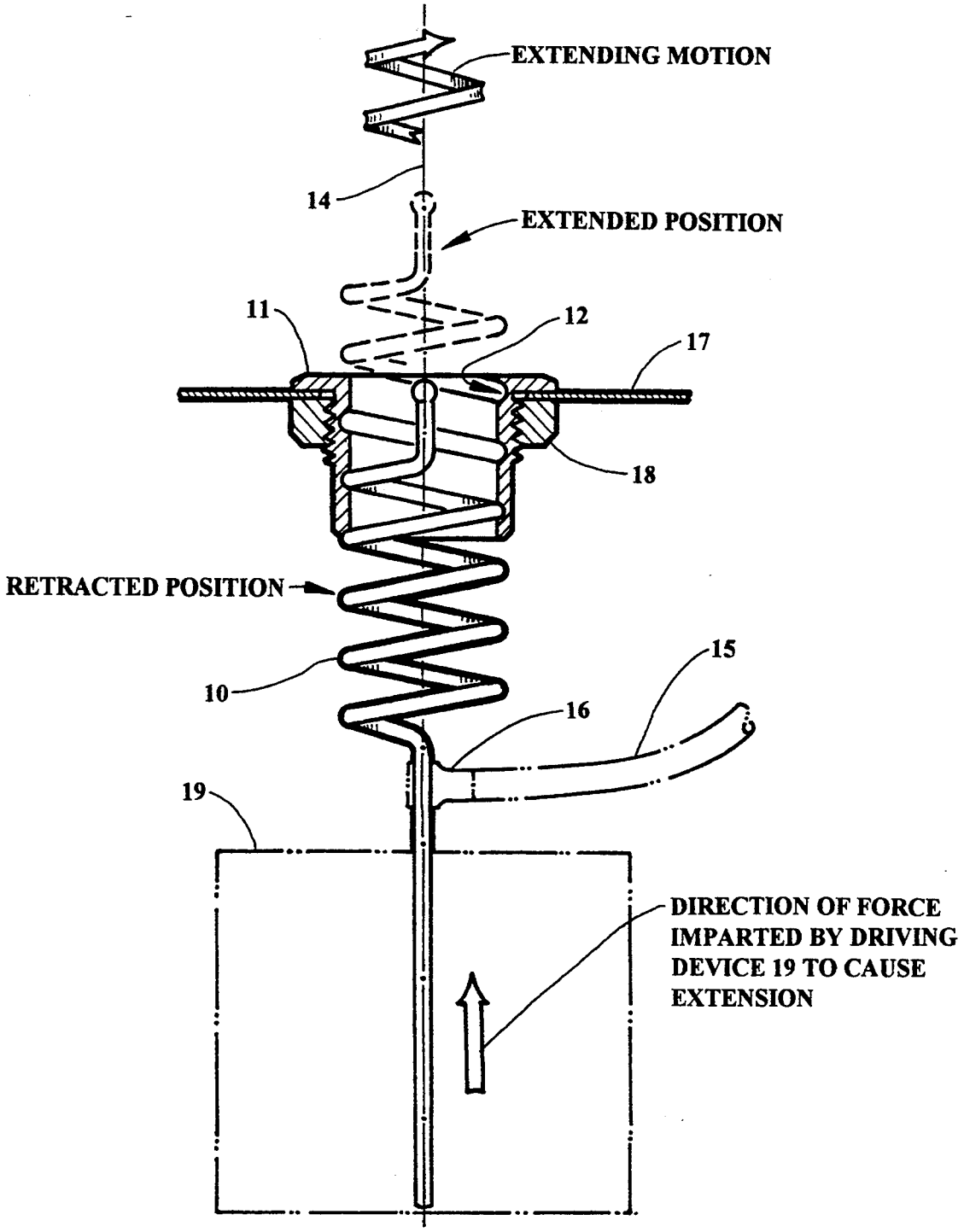
FIG. 4 is a cross sectional view of an embodiment of the invention employing an axial driver with said driver represented schematically.
Figure 5:
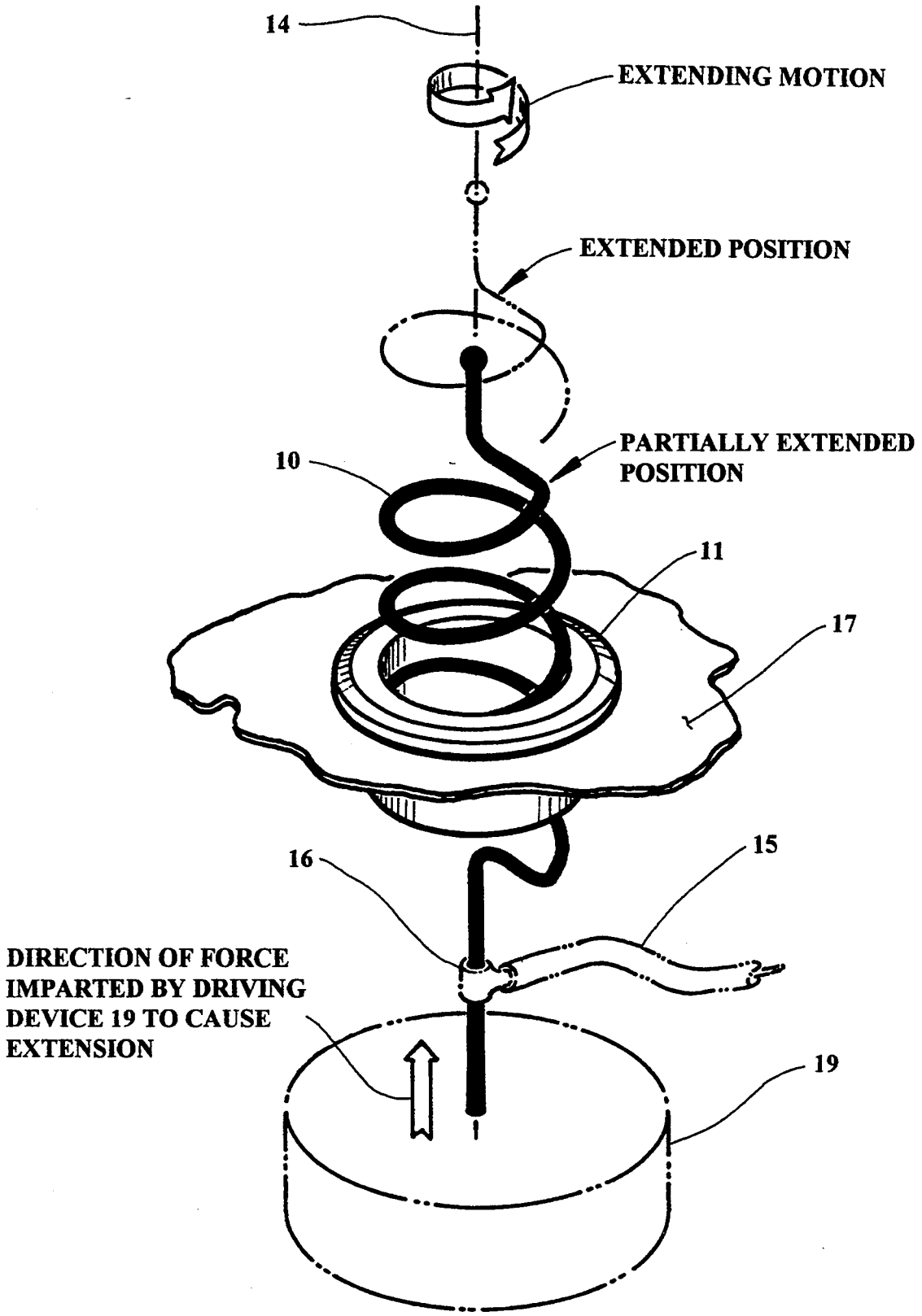
FIG. 5 is a perspective view of the embodiment of the invention of FIG. 4.

Referring to FIGS. 2 and 3, which illustrate the same embodiment and share like reference numbers with like parts of the embodiment depicted in FIGS. 4 and 5, an assembly is depicted which comprises a helical antenna shaft (10) shown retracted in solid line and extended in phantom line, a guide bushing (11) including a helical groove (12) so as to mate freely with the helical shaft (10), and a rotational driving device (13) shown in schematic form. Said driving device (13) being fixedly attached so as to prevent rotation caused by its self-generated torque, and being any one of many common devices such as an electrical motor, an air driven motor, a hydraulic device, or the like, whose sole purpose is to impart rotation to the shaft (10) about the helical axis (14) while allowing freedom in the axial direction for the shaft (10) to translate helically about said axis (14) while being guided by the helical groove (12) of the guide bushing (11). The antenna shaft (10) remains electrically connected to the antenna wire (15) while rotating via a connector (16) which allows free rotation of the shaft (10) while maintaining electrical contact. The guide bushing (11) is shown mounted to a surface (17) such as an automobile fender, by engagement with a mating nut (18). As a result of the rotational force imparted on the shaft (10), said shaft helically threads within said helical groove (12) to either retract or extend from said surface (17), depending on the direction of rotation, thereby performing the desired function.

Referring to FIGS. 4 and 5, an assembly is depicted which comprises the same components as the first embodiment except that the driving device (19) is an axial acting type, for example an hydraulic piston or electrical solenoid, rather than the rotational driving device (13) of FIGS. 2 and 3, and said device (13) allows free rotation of the shaft (10) about the helical axis (14). As a result of the axial force imparted on the shaft (10), said shaft helically threads within said helical groove (12) to either retract or extend from said surface (17), depending on the direction of said force, thereby performing the desired function.

What I claim is:

1. A retractable helical antenna assembly comprising:
   - an antenna of the type helically coiled, said helical coil having a longitudinal axis, said antenna having a free end portion and an end portion adapted for electrical connection;
   - a bushing having a hole fully therethrough, said hole having two open ends and thread means formed therein which freely engage said helical coil; and
   - a driver engaging said antenna at said end portion adapted for electrical connection, to cause helical motion to said antenna relative to said bushing, and thereby displace said antenna along said longitudinal axis such that said antenna may be extended from and fully retracted within said bushing through said hole and said thread means.

2. The antenna assembly of claim 1 wherein said thread means is a helical groove.

* * * * *